US008640426B2

(12) United States Patent
Wang et al.

(10) Patent No.: US 8,640,426 B2
(45) **Date of Patent: *Feb. 4, 2014**

(54) THERMAL BARRIERS OF ELEVATOR DOOR ROLLER AND RAIL

(75) Inventors: Jinliang Wang, Ellington, CT (US); Xiaomei Yu, Glastonbury, CT (US); Mikhail B. Gorbounov, South Windsor, CT (US); John M. Milton-Benoit, West Suffield, CT (US); Zlatko Strbuncelj, Avon, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/059,118

(22) PCT Filed: Oct. 6, 2008

(86) PCT No.: PCT/US2008/078909

§ 371 (c)(1),
(2), (4) Date: Feb. 15, 2011

(87) PCT Pub. No.: WO2010/042098

PCT Pub. Date: Apr. 15, 2010

(65) Prior Publication Data

US 2011/0147131 A1 Jun. 23, 2011

(51) Int. Cl.
*E06B 5/16* (2006.01)

(52) U.S. Cl.
USPC ..... 52/783.13; 52/30; 187/334

(58) Field of Classification Search
USPC ..... 52/323, 30, 784.11, 783.13, 232; 187/316, 333, 334
See application file for complete search history.

(56) References Cited

U.S. PATENT DOCUMENTS

| | | | | | |
|---|---|---|---|---|---|
| 4,514,524 | A | * | 4/1985 | Fesman | 521/107 |
| D279,409 | S | * | 6/1985 | Allen, Jr. | D25/124 |
| 4,530,189 | A | * | 7/1985 | Randall | 52/30 |
| 4,849,459 | A | * | 7/1989 | Grace et al. | 521/110 |
| 5,127,203 | A | * | 7/1992 | Paquette | 52/241 |
| 5,293,962 | A | * | 3/1994 | Pelvilain | 187/333 |
| 5,377,784 | A | | 1/1995 | Walkowiak et al. | |
| 5,673,770 | A | * | 10/1997 | Friedman | 187/333 |

(Continued)

FOREIGN PATENT DOCUMENTS

| | | | |
|---|---|---|---|
| CN | 1059405 | C | 12/1993 |
| CN | 1270139 | A | 10/2000 |

(Continued)

OTHER PUBLICATIONS

The Jun. 30, 2009 International Search Report for PCT International Application No. PCT/US2008/078909.

(Continued)

*Primary Examiner* — Andriana Figueroa
(74) *Attorney, Agent, or Firm* — Kinney & Lange, P.A.

(57) ABSTRACT

A roller assembly includes a frame (16) defining a doorway (14). A rail (32), which includes at least one supporting surface along at least one side of the rail, is secured to the frame (16). At least one roller (38), which is adapted to roll along the supporting surface of the rail (32), has a tire material (68) that contacts the rail (32). A thermal barrier (62, 70, 72, 76, 80) is positioned to inhibit heat transfer from the rail (32) to the tire material (68).

30 Claims, 6 Drawing Sheets

(56) References Cited

U.S. PATENT DOCUMENTS

| | | | | |
|---|---|---|---|---|
| 5,797,471 | A | 8/1998 | Princell | |
| 5,921,041 | A * | 7/1999 | Egri, II | 52/241 |
| 5,988,321 | A | 11/1999 | Kondo | |
| 6,125,608 | A * | 10/2000 | Charlson | 52/847 |
| 6,176,053 | B1 * | 1/2001 | St. Germain | 52/232 |
| 6,945,364 | B1 * | 9/2005 | Wesson et al. | 187/334 |
| 6,981,351 | B2 * | 1/2006 | Degelsegger | 52/784.11 |
| 7,140,471 | B2 | 11/2006 | Studhalter | |
| 7,143,871 | B2 | 12/2006 | Wesson et al. | |
| 7,270,217 | B1 | 9/2007 | Haney | |
| 2001/0053257 | A1 * | 12/2001 | Takatsu | 384/543 |
| 2002/0139621 | A1 * | 10/2002 | Watabe et al. | 187/336 |
| 2004/0025455 | A1 * | 2/2004 | Nubel et al. | 52/204.51 |
| 2004/0124038 | A1 * | 7/2004 | Wesson et al. | 187/334 |
| 2006/0075708 | A1 * | 4/2006 | Watabe et al. | 52/456 |
| 2006/0137293 | A1 * | 6/2006 | Klein | 52/782.1 |
| 2006/0191217 | A1 * | 8/2006 | Harkins et al. | 52/232 |
| 2006/0289242 | A1 * | 12/2006 | Oberer et al. | 187/333 |
| 2011/0147131 | A1 * | 6/2011 | Wang et al. | 187/333 |

FOREIGN PATENT DOCUMENTS

| | | | |
|---|---|---|---|
| CN | 1004-08462 | C | 12/2006 |
| GB | 1470491 | A | 4/1977 |
| JP | 54085735 | A | 7/1979 |
| JP | 8100561 | A | 4/1996 |
| JP | 8119563 | A | 5/1996 |
| JP | 9317306 | A | 12/1997 |
| JP | 2000255919 | A | 9/2000 |
| JP | 2003246571 | A | 9/2003 |
| WO | W02007018488 | A1 | 2/2007 |

OTHER PUBLICATIONS

The translation of the Japanese Office Action mailed Dec. 28, 2012 for Japanese Application No. 2011-530034.

English Translation of Chinese Search Report, dated Mar. 16, 2013.

English Translation of Chinese First Office Action, mailed Apr. 3, 2013.

Chinese Second Office Action, issued Sep. 23, 2013.

* cited by examiner

THERMAL BARRIERS OF ELEVATOR DOOR ROLLER AND RAIL

CROSS-REFERENCE TO RELATED APPLICATIONS

Reference is hereby made to the following co-pending applications, which were filed on even date with the current application: "INTUMESCENT THERMAL BARRIER FROM HUB TO TIRE", Wang et al., application Ser. No. 13/059,114.

BACKGROUND

The present invention relates to an elevator shaft closure, which is preferably used for elevator installations with fire protection requirements as are demanded in known standards.

The elevator shaft closure enables access from the floor to the car. It includes the principal parts of a door frame and at least one door leaf. The door frame, typically including a header and/or ceiling plate, is alternatively connected, depending on the type of building, directly with a wall or on a foundation frame. At least one door leaf is slidably mounted in the door frame. Depending on the possible forms of arrangement of the door leaves, distinction is then made between single-leaf or multi-leaf telescopic doors or center doors. Telescopic doors close and open on one side, whereas center-opening doors close from both sides towards the center or middle of the door opening (and open from the middle of the door opening toward both sides). Each door is actuated by exertion of a force onto the door, and the door moves via one or more rollers attached to the door interacting with a rail.

The fire safety of elevator landing door systems during fires in buildings is ensured by a standard fire test of door assemblies regulated by the requirements defined in an applicable country standard. For example, under the UL 10B standard in the United States, the temperature in a test heating furnace gradually ramps from ambient to 982° C. during 90 minutes to simulate possible fire conditions in an actual building. One of the primary requirements for successfully passing the test is absence of visible flames in any component of the door assembly for the whole duration of the test. For example, in a typical test furnace the temperature is controlled by a specified time-temperature curve; any flaming on the unexposed door surface is recorded. The test typically requires that no flame should be observed on the unexposed door surface during the first 30 minutes, and no flame should last more than five (5) seconds after thirty minutes during testing.

In light of the foregoing, the present invention aims to resolve one or more of the aforementioned issues that afflict elevator systems, particularly door assemblies.

SUMMARY

An embodiment of the present invention is directed to a door assembly. The assembly has a door header mounted on a frame defining a doorway, a door movably supported on the frame, and a rail including at least one supporting surface along at least one side of the rail. The rail is secured to the door header. The assembly also has at least one roller that is adapted to roll along the supporting surface of the rail. The roller has a tire material that contacts the rail. A thermal barrier is positioned to prevent heat transfer from the rail to the tire material.

Another embodiment of the invention addresses an elevator. The elevator includes, among other possible things, a hoistway and a car configured to move vertically with the hoistway. The hoistway has one or more hoistway doorways. The car includes a door assembly and a car doorway that is configured to be aligned with the one or more doorways of the hoistway. The door assembly includes a door header, a door, a rail, at least one roller, and a thermal barrier. The door header is mounted on a frame defining the car doorway. The door is movably supported on the frame. The rail, which includes at least one supporting surface along at least one side of the rail, is secured to the door header. The at least one roller is adapted to roll along the supporting surface of the rail. The roller has a tire material that contacts the rail. The thermal barrier is positioned to prevent heat transfer from the rail to the tire material.

In another embodiment, the invention is directed to a roller assembly. The roller assembly has a frame defining a doorway, and a rail including at least one supporting surface along at least one side of the rail. The rail is secured to the frame. At least one roller is adapted to roll along the supporting surface of the rail, and the roller has a tire material that contacts the rail. A thermal barrier is applied to a portion of the roller assembly to prevent heat transfer from the rail to the tire material.

In yet another embodiment, a method includes providing a door assembly mounted on a frame defining a doorway for at least one door, wherein the one door is movably supported on the frame by attachment to at least one roller with a tire material supported on a rail secured to the frame. A thermal barrier is applied to at least a portion of the door assembly to inhibit heat transfer from the rail to the tire material.

It is to be understood that both the foregoing general description and the following detailed description are exemplary and explanatory only, and are not restrictive of the invention as claimed.

BRIEF DESCRIPTION OF THE DRAWINGS

These and other features, aspects, and advantages of the present invention will become apparent from the following description, appended claims, and the accompanying exemplary embodiments shown in the drawings, which are hereafter briefly described.

DETAILED DESCRIPTION

Figure 1:
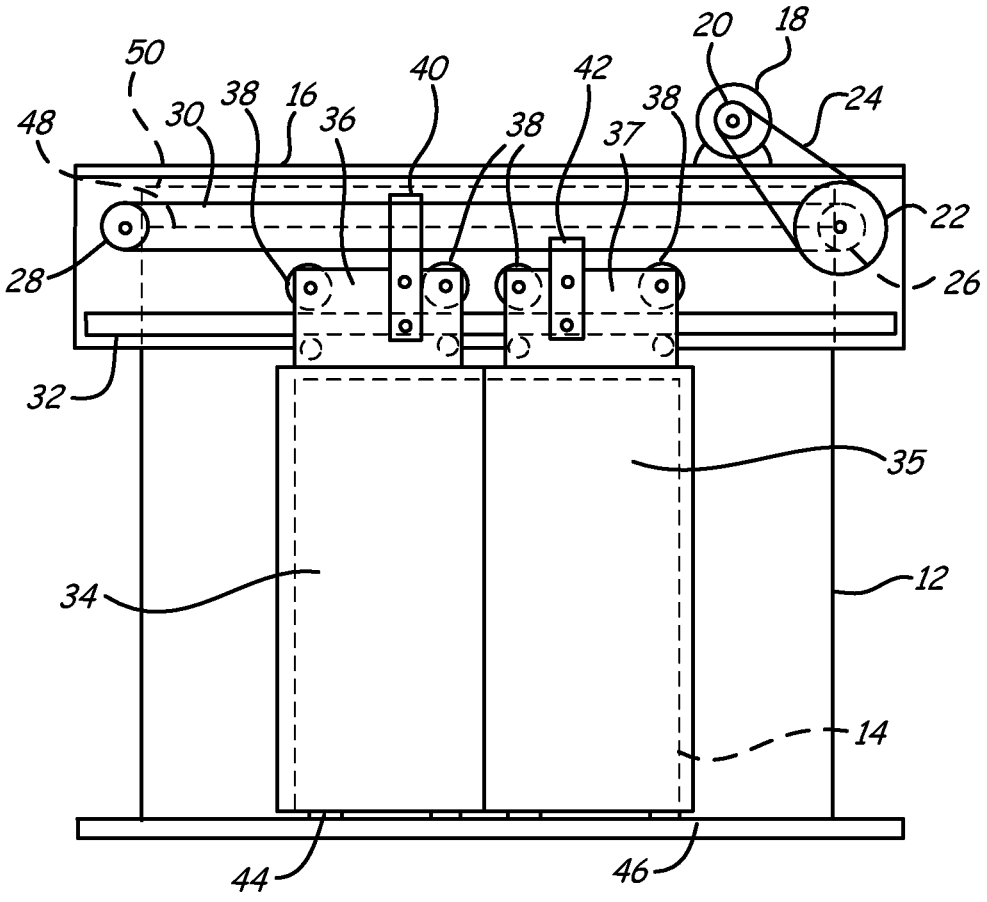
Fig. 1 PRIOR ART
FIG. 1 is a front elevation view illustrating a conventional elevator car.

Through the inventors' efforts, it has been determined that during a fire, door assemblies may experience elevated temperatures through convective, conductive, and/or radiated heat. Door components, including the door hanger, roller, and rail, may be heated by the hot air surrounding the components, which is convective heat. Radiated heat may result from heat transfer from a higher temperature component to a lower temperature component in close proximity to the higher temperature component. Typically, such radiated heat comes from components with larger mass, such as the doors themselves, or headers and ceiling plates adjacent the other door assembly components. Conductive heat results when adjacent components are in contact allowing for the transfer of heat from one component to another. This results in the possibility of heat quickly spreading from one component to another.

During a fire, the door and header may be directly exposed to heat. With the door and header temperature increasing, heat may spread under unique circumstances from the door to the door hanger and/or from the header to the rail. Meanwhile, it is also conceivable that air around the door may be heated and rise under natural convection; hot air will directly heat the track and other components in the flow path of the leaked air. The rollers may be heated by heat that flows from the track, hanger, and the rising air. Any gap between the doors and header during the fire may result in hot air leaking from the furnace, further accelerating the temperature increase of the door assembly.

Elevator cars and door assemblies typically contain rollers that are coated with a polymer. The rollers have a metallic (such as steel or aluminum) rim and hub hosting a bearing, and a tire material around the rim (such as the aforementioned polymer). The rollers are connected to the door through the door hanger, and sit on the door rail. The rail is fastened to the header to distribute the door weight from the track to the wall. During a fire, it is conceivable that high temperatures may soften and melt the polymer of the tire on the roller, thereby reducing the thickness of the polymer between the rollers and rail. In the unlike event of such reduced thickness, a thermal shortcut between the rail and rollers may theoretically result. In light of these potential problems, the embodiments hereafter described aim to enhance the robustness of traditional door systems (and in particular the door rollers) to better enable the door systems to combat the potential negative effects of the heat associated with a building fire.

Efforts have been made throughout the drawings to use the same or similar reference numerals for the same or like components.

FIG. 1 is a front elevation view illustrating conventional elevator car 12. As illustrated, elevator car doorway (also referred to as an entrance) 14 is provided at the front face of car body 12. Door frame 16 extends along the width of doorway 14, and is fixed to car body 12 above doorway 14. Door motor 18 having motor pulley 20 is mounted on door frame 16. Reduction pulley 22 having a larger diameter than motor pulley 20 has belt 24 wound between motor pulley 20 and reduction pulley 22. Drive pulley 26, which has a smaller diameter than and is coaxial with reduction pulley 22, can be rotated integrally with the reduction pulley 22. Following pulley 28 is provided at the door frame 16, with second belt 30 wound between drive pulley 26 and following pulley 28.

Door rail 32 extends along the width direction of doorway 14 and is attached to door frame 16. Two car doors 34, 35 are suspended from door rail 32 through door hangers 36, 37. Each door hanger 36, 37 has two rollers 38 which are rotated along door rail 32. Car doors 34, 35 are connected to second belt 30 through door hangers 36, 37 and belt holders 40 and 42. A plurality of door shoes 44 are attached adjacent the lower edge of each of doors 34, 35. Door shoes 44 are inserted into a groove (not shown) of sill 46 disposed at the lower portion of doorway 14. Further, car body 12 is provided with a header that has upper panel 48 and ceiling panel 50.

During operation, motor pulley 20 is rotated by door motor 18, and the rotation is transmitted to reduction pulley 22 through reduction belt 24. Drive pulley 26 is rotated with reduction pulley 22, and thus second belt 30 is circulated and following pulley 28 is rotated. Since door hangers 36, 37 are connected to belt 30, door hangers 36, 37 and doors 34, 35 are reciprocated along door rail 32 by the circulation of second belt 30 to open or close doorway 14. Doors 34, 35 are suspended from door rail 32 and the door shoes 44 of doors 34, 35 are guided by the sill groove of sill 46 during the opening and the closing of doors 34, 35.

Figure 2:
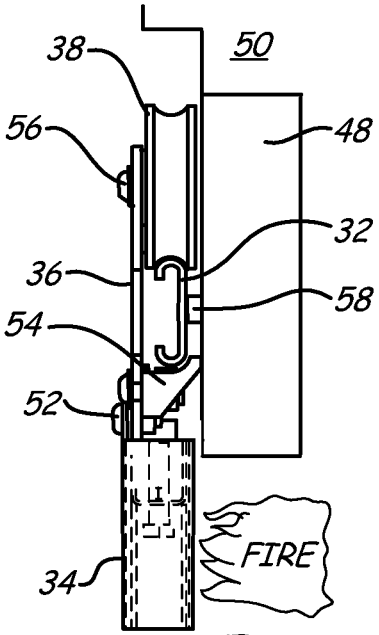
FIG. 2 is a cross-sectional view of an upper portion of the elevator car.

FIG. 2 is a cross-sectional view of an upper portion of elevator car 12. From this view, door 34 is connected to roller 38 by door hanger 36. In this embodiment, door hanger 36 is a relatively flat plate with apertures to allow for connection to adjacent components. Fastener 56 secures roller 38 with respect to the top of door hanger 36, while fastener 52 secures door hanger 36 with respect to the top of door 34. Fasteners 52 and 56 may be bolts, pins, machine screws, rivets, or similar devices known in the art. Roller 38 is a pulley, sheave, ring, wheel or similar structure also known in the art.

Also attached to door hanger 36 is bottom rail support 54. In the embodiment illustrated, bottom rail support 54 is a bracket with a smooth surface that engages the bottom of rail 32, and permits travel with respect thereto. In alternate embodiments, bottom rail support is a bearing, roller, wheel, or similar structure that allows for low friction engagement with rail 32. Rail 32 is a track on which roller 38 may travel, and is illustrated as being generally parallel to the tops of doors 34, 35 (See FIG. 1). Rail 32 is connected to upper panel 48 through attachment 58, which may be a fastener or mounting bracket to secure rail 32 in position. Rail 32 is secured in a fashion that permits movement of roller 38 and door hanger 36, and thus door 34, along rail 32. Upper panel 48 is joined to ceiling panel 50.

Figure 3:
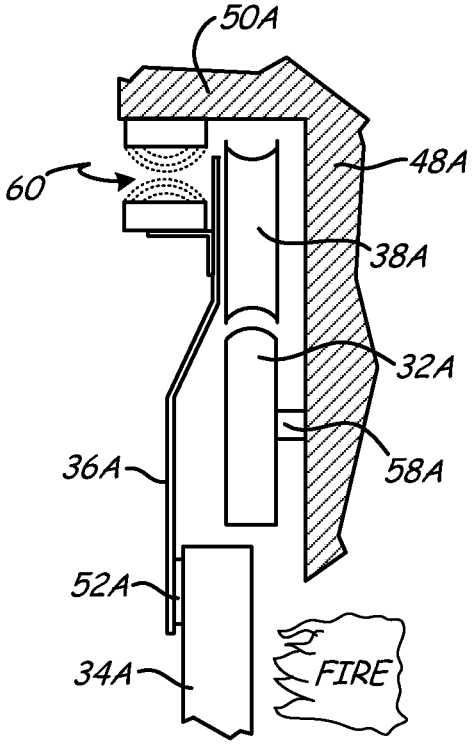
FIG. 3 is a cross-sectional view of an alternate embodiment of an upper portion of the elevator car.

FIG. 3 is a cross-sectional view of an alternate embodiment of an upper portion of elevator car 12. In this embodiment, upper panel 48A is continuous with ceiling panel 50A. Rail 32A is attached to upper panel 48A with fastener 58A. Roller 38A rotatably engages rail 32A, and is connected to door 34A by door hanger 36A. Door hanger 36A is angled to allow for proper positioning of roller 38A with respect to door 34A, and is connected to door 34A by fastener 52A. Roller 38A and door hanger 36A are also connected to positioning apparatus 60. In one embodiment, positioning apparatus has an upper and lower magnet. The polarities of the magnets are arranged to provide desired interaction between the upper and lower magnets, which will create the desired force for creating movement of door 34A from the motion of roller 38A with respect to rail 32A.

A flame is illustrated in both FIGS. 2 and 3 adjacent the top of door 34 (and 34A), representing a fire within the building housing elevator car 12. A fire may result in increased temperature for the surrounding area, including elevator car 12. As illustrated, it is conceivable that the fire may affect the elevator car in several ways. First, higher temperatures may possibly result in conduction temperature increases in the rail and hanger. Second, the gap adjacent door 34 and upper panel 48 (and door 34A and upper panel 48A) may possibly allow for convection heating of adjacent elements. Third, a rise in air temperature may possibly affect the components of elevator car 12, especially roller 38. Fourth, and finally, the fire may possibly result in an increase in radiated heat from door 34 and upper panel 48 and ceiling panel 50. The current invention minimizes the small likelihood that these effects of a fire could conceivably have on elevator car 12.

Figure 4A:
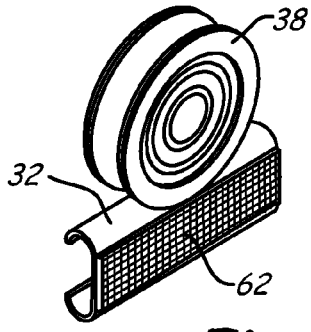
FIG. 4A is a perspective view of an embodiment of a rail and a roller for an elevator car.
Figure 4B:
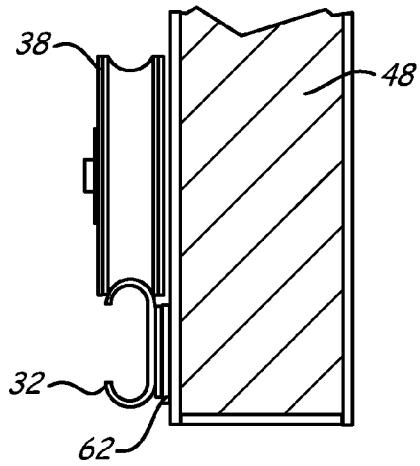
FIG. 4B is a cross-sectional view of a portion of an elevator car including the rail and the roller of FIG. 4A.

FIG. 4A is a perspective view of rail 32 and roller 38. FIG. 4B is a cross-sectional view of a portion of an elevator car including rail 32 and roller 38. Roller 38 is a machined wheel fabricated from carbon steel or aluminum. In both illustrations, a strip 62 of thermal resistant material has been added to a portion of rail 32. The strip extends along the length of the rail, and covers the area of contact between rail 32 and upper panel 48. Strip 62 is a very low thermal conductivity material or coating. Strip 62 reduces the heat conducted to rail 32, and thus roller 38, from the header as represented by upper panel 48 in the embodiment illustrated.

Figure 4C:
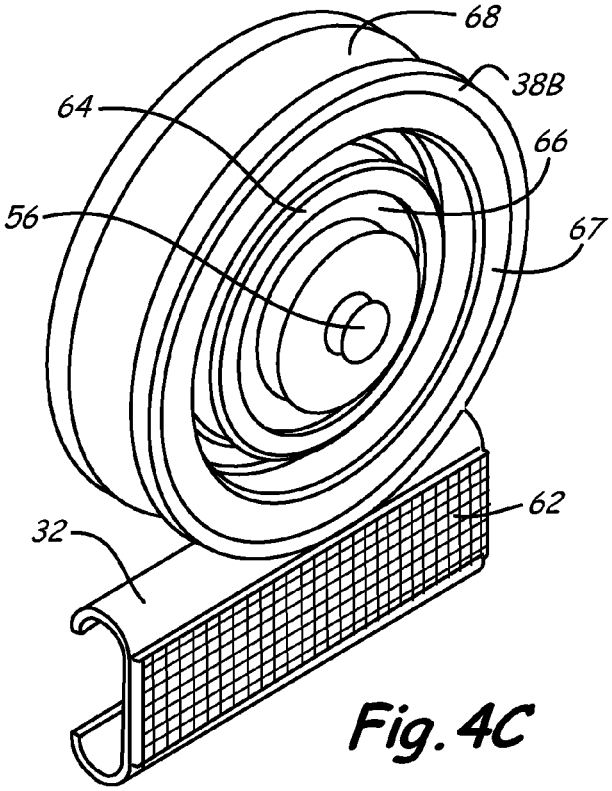
FIG. 4C is a perspective view of an alternate embodiment of a rail and a roller for an elevator car.

FIG. 4C is a perspective view of rail 32 with another embodiment of roller 38B. In this embodiment, roller 38B is a wheel manufactured by stamping, and constructed from steel. Roller 38B contains rim 67, which is constructed from a rigid material, such as aluminum or carbon steel. In one embodiment, roller 67 is cylindrical, and has two flanges extending from a radially outer surface to create a channel, as is common with similar structures such as pulleys or sheaves. The radially inner surface of rim 67 is connected to hub 64, which secures bearing 66. Hub 64 is constructed from a material similar or the same as rim 67. Bearing 66 is a common bearing known in the art, such as a roller, ball, cage, or tapered wheel bearing. Bearing 66 receives fastener 56 to attach roller 38B to door hanger 36. The outer surface of rim 67 contains ring 68. Ring 68 typically consists of a polymer-based tire material that interacts with rail 32. In one embodiment, ring 68 is a tire material secured to the radially outer surface of rim 67, between two generally parallel flanges of rim 67.

Strip 62 of thermal resistant material has been attached to rail 32. Strip 62 extends along the length of the rail, and covers the area of contact between rail 32 and the header (not shown). Rail 32 is constructed form a rigid material, such as metal. Again, strip 62 is a very low thermal conductivity material or coating. In one embodiment, strip 62 is a ceramic material. In other embodiments, strip 62 is a metal with a lower thermal conductivity than the material of rail 32, a composite, or similar insulating material. Specifically, strip 62 may be silica, mineral wool, ceramic fiber, fiberglass, alumina fiber, or alumina-silica fiber. Strip 62 may be a solid sheet of material attached to rail 32, or may be a coating applied to rail 32. Strip 62 reduces the heat transferred to rail 32, and thus roller 38, from the header or wall 48. Providing strip 62 in the door assembly allows for designs wherein roller 38 and rail 32 can be positioned closer to the header, including wall 48, without the worry of conductive and radiated heat transfer to the rail 32. This design reduces the amount of space needed for the door assembly. In alternate embodiments, Strip 62 may cover additional portions of rail 32, or header or wall 48, or both to further prevent conductive and radiated heat transfer to rail 32.

Figure 5:
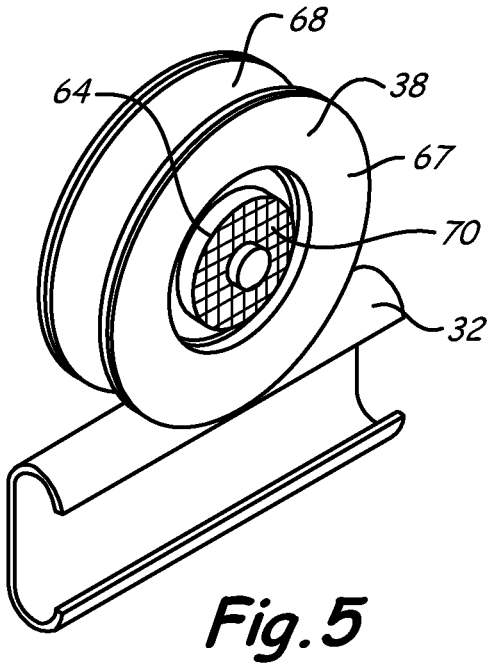
FIG. 5 is a perspective view of an embodiment of a roller on a rail with a thermal barrier applied to a hub of the roller.
Figure 6:
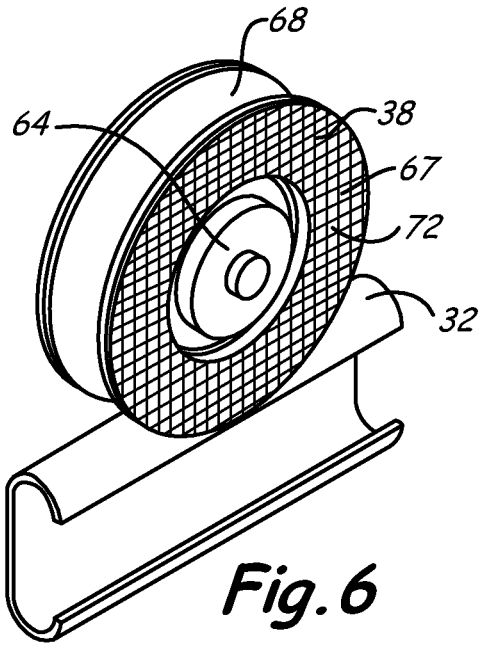
FIG. 6 is a perspective view of an embodiment of a roller on a rail with a thermal barrier applied to a rim of the roller.

FIG. 5 and FIG. 6 are perspective views of roller 38 on rail 32. Roller 38 contains rim 67, which is a circular flange structure or sheave constructed from a rigid material, such as aluminum or carbon steel. Rim 67 is connected to hub 64, which secures a bearing and fastener for attaching roller 38 to door hanger 36. Hub 64 is constructed from a material similar or the same as rim 67, which may be a metal such as aluminum or carbon steel. Hub 64 may be fabricated as a part attached to rim 67. In other embodiments, hub 64 is a flange structure secured to rim 67, or a flat piece of material such as a washer that is used to hold a bearing in place with respect to rim 67. The outer surface of rim 67 contains ring 68. Ring 68 typically consists of a polymer based tire material that interacts with rail 32.

A thermal barrier 70 has been applied to hub 64 in FIG. 5. Similarly, thermal barrier 72 has been applied to rim 67 in FIG. 6. Thermal barriers 70, 72 are low thermal conductive materials, such as ceramics, composites, or similar insulating materials. Specifically, thermal barriers 70, 72 may be ceramic coatings including paints, intumescent layers, multilayer low thermal conduction coatings, and the like. Thermal barriers 70, 72 are applied as coatings, or are strips of material secured to roller 38. Thermal barriers 70, 72 reduce heat conduction to roller 38 from door hanger 36, as well as reduce heat convection to roller 38 from higher temperature air surrounding the roller in an elevated temperature setting. Roller 38 may contain one or both thermal barriers 70, 72, depending on the design of the surrounding door assembly components and roller 38 proximity thereto. This again provides of the benefit of reducing heat transfer among door assembly components, which allows for a more compact door assembly design. For example, thermal barrier 70 prevents heat conduction to roller 38 from the air, while thermal barrier 72 reduces heat conduction of rim 67 of roller 38 to door hanger 36, 37.

Figure 7A:
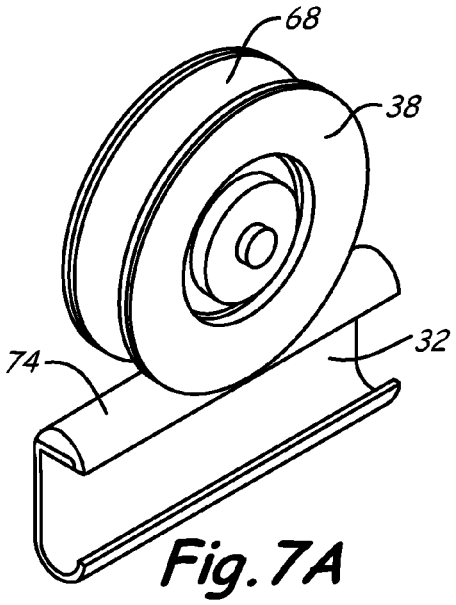
FIG. 7A is a perspective view of an embodiment of a roller on a rail having a thermal barrier along the top portion of the rail.

FIG. 7A is a perspective view of roller 38 on rail 32. Roller 38 contains ring 68, which is a polymer based tire material that contacts rail 32. Rail 32 contains a top portion 74 that contacts ring 68. Top portion 74 is constructed from a low thermal conductivity material. Top portion 74 may be manufactured separately from the rest of rail 32, and the two parts then are secured together. Top portion 74 inhibits heat transfer between rail 32 and roller 38.

Figure 7B:
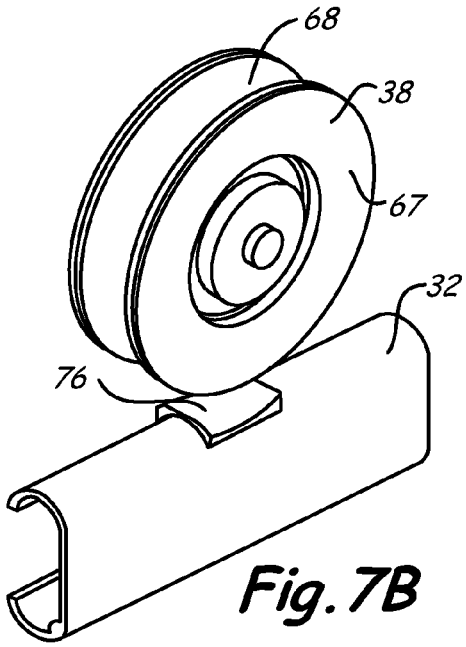
FIG. 7B is a perspective view of an embodiment of a roller and a rail containing a thermal barrier saddle.
Figure 7C:
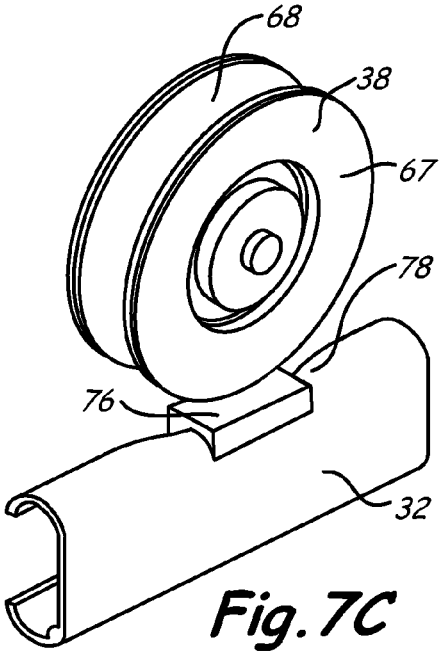
FIG. 7C is a perspective view of the roller and the rail of FIG. 7B containing the thermal barrier saddle within an indentation in the rail.

FIGS. 7B and 7C are both perspective views of roller 38 on rail 32. Again, roller 38 contains rim 67 that supports ring 68. Roller 38 and ring 68 are constructed as previously described. Similarly, rail 32 is a metal track that allows for rotary movement of roller 38 thereon. In these embodiments, rail 32 contains a saddle 76, which acts as a thermal barrier. That is, saddle 76 is constructed from a material that inhibits the transfer of heat between rail 32 and roller 38. Roller 38 is illustrated as being spaced above rail 32 for purposes of showing saddle 76. In use, roller 38 is in contact with rail 32.

Saddle 76 is positioned on rail so that when doors 34, 35 are in the closed position (see FIG. 1), roller 38 does not directly contact rail 32. That is, saddle 76 is between rail 32 and roller 38. Saddle 76 is a piece of material secured to rail 32, or a small area of coating on rail 32. As illustrated in FIG. 7B, saddle 76 is a thermal barrier added to an existing rail 32. In FIG. 7C, rail 32 has been specially manufactured to contain indentation 78. Saddle 76 is placed in indentation 78 such that the top of saddle 76 is parallel to the top of rail 32 to assure smooth travel of roller 38 on rail 32. In other embodiments, saddle 76 may extend along a length of rail 32.

Figure 8A:
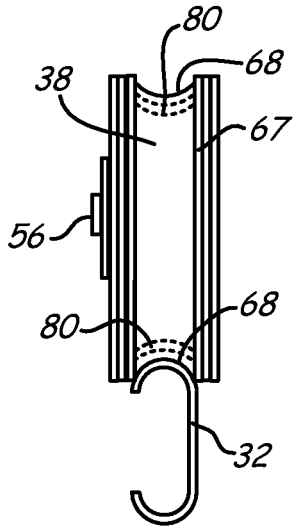
FIG. 8A is an elevation view of another embodiment of a rail and roller of an elevator door system.
Figure 8B:
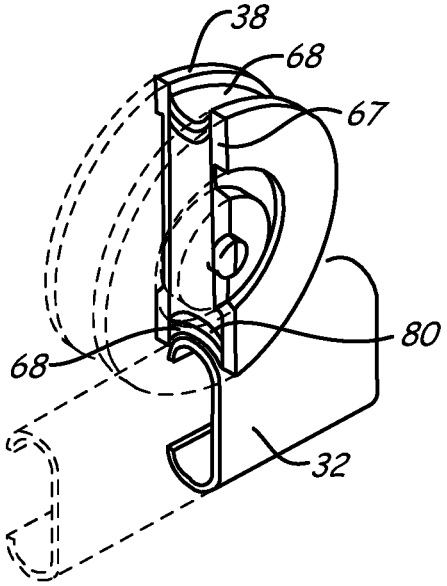
FIG. 8B is a partial section of a perspective view of the rail and roller illustrated in FIG. 8A.

FIG. 8A is an elevation view of another embodiment of rail 32 and roller 38. FIG. 8B is a partial section of a perspective view of rail 32 and roller 38 illustrated in FIG. 8A. Roller 38 contains fastener 56 for securing the roller to the door assembly. Roller 38 also has ring 68, which is again a tire material that contacts rail 32. In one embodiment, ring 68 is a polymer such as polyurethane. In this embodiment, thermal barrier 80 is present between the rim 67 of roller 38 and ring 68. Thermal barrier is an intumescent layer, which may be applied as an adhesive between the rim 67 of roller 38 and ring 68. The intumescent material has a starting expansion temperature that is below the tire melting temperature. Once the intumescent material reaches the starting expansion temperature, a chemical reaction will be initiated resulting in the swelling of the layer. The resultant increase in volume and decrease in density also relates to a decrease in thermal conductivity of the material. In one embodiment, thermal barrier 80 will increase up to 350 times in volume, and result in a ten-fold decrease in thermal conductivity. This results in a blocking of heat transfer from the track to the hub. By reducing the heating speed of ring 68 and managing ring temperature below the melting temperature, the tire will not be melted and thus cause visible flame. This effectively eliminates one of the causes of failure during door fire testing.

Examples of materials for use as thermal barrier 80 are adhesives for polyurethane and metal surfaces mixed with 1-20% of expandable graphite having SET 150-160C such as Nord-Min®150, Grafguard® 160, and Minelco FireCarb TEG-160. The adhesion force between tire and hub is maintained at 90% or higher than its original strength before adding the expandable graphite. The adhesion force will not be reduced within the designed life time of roller 38.

The application of thermal barriers 62, 70, 72, 76 allow for a method in which a door assembly mounted on a frame defining a doorway for at least one door is provided, wherein the one door is movably supported on the frame by attachment to at least one roller supported on a rail secured to the frame. A thermal barrier is applied to at least a portion of the door assembly. The aforementioned thermal barriers 62, 70, 72, 76, 80 may be applied as desired or required for the design of roller 38 and rail 32. All embodiments of thermal barriers 62, 70, 72, 76, 80 may be used individually or in combination with the other embodiments.

The application of thermal barrier 80 allows for a method in which a door assembly mounted on a frame defining a doorway for at least one door is provided, wherein the one door is movably supported on the frame by attachment to at least one roller supported on a rail secured to the frame. A roller for supporting the door on the rail is fabricated, and the roller has a rim portion with a hub portion radially inward of the rim portion. A thermal barrier is applied to at least a portion of the radially outer surface of the rim portion, and a tire material is then secured to the radially outer surface of the rim portion.

The aforementioned discussion is intended to be merely illustrative of the present invention and should not be construed as limiting the appended claims to any particular embodiment or group of embodiments. Thus, while the present invention has been described in particular detail with reference to specific exemplary embodiments thereof, it should also be appreciated that numerous modifications and changes may be made thereto without departing from the broader and intended scope of the invention as set forth in the claims that follow.

The specification and drawings are accordingly to be regarded in an illustrative manner and are not intended to limit the scope of the appended claims. In light of the foregoing disclosure of the present invention, one versed in the art would appreciate that there may be other embodiments and modifications within the scope of the present invention. Accordingly, all modifications attainable by one versed in the art from the present disclosure within the scope of the present invention are to be included as further embodiments of the present invention. The scope of the present invention is to be defined as set forth in the following claims.

The invention claimed is:

1. A door assembly comprising:

a door header mounted on a frame defining a doorway;

a door movably supported on the frame;

a rail including at least one supporting surface along at least one side of the rail, the rail secured to the door header;

at least one roller that is adapted to roll along the supporting surface of the rail, the roller having a tire material that contacts the rail; and a thermal barrier positioned to prevent heat transfer from the rail to the tire material;

wherein the thermal barrier is selected from the group consisting of silica, mineral wool, ceramic fiber, fiberglass, alumina fiber, alumina-silica fiber, ceramic coatings, intumescent material, and multilayer thermal barrier coating, and wherein the thermal barrier covers at least a portion of the rail.

2. The assembly of claim 1, wherein the thermal barrier covers the supporting surface of the rail.

3. The assembly of claim 1, wherein the thermal barrier covers at least a portion of the rail that is contacted by the roller when the door is in a closed position.

4. The assembly of claim 1, wherein the thermal barrier covers at least the portion of the rail that is contacted by the tire material of the roller.

5. The assembly of claim 1, wherein the thermal barrier is a coating applied to the rail.

6. The assembly of claim 1, wherein the thermal barrier is fabricated from a sheet of material secured to the rail.

7. The assembly of claim 1, wherein a second thermal barrier covers a rim portion of the roller.

8. The assembly of claim 1, wherein a second thermal barrier covers a hub portion of the roller.

9. An elevator comprising:

a hoistway having one or more hoistway doorways;

a car configured to move vertically with the hoistway, the car comprising:

a car doorway configured to be aligned with the one or more hoistway doorway; and a door assembly comprising:

a door header mounted on a frame defining the car doorway;

a door movably supported on the frame;

a rail including at least one supporting surface along at least one side of the rail, the rail secured to the door header;

at least one roller that is adapted to roll along the supporting surface of the rail, the roller having a tire material that contacts the rail; and a thermal barrier positioned to prevent heat transfer from the rail to the tire material;

wherein the thermal barrier is selected from the group consisting of silica, mineral wool, ceramic fiber, fiberglass, alumina fiber, alumina-silica fiber, ceramic coatings, intumescent material, and multilayer thermal barrier coating, and wherein the thermal barrier covers at least a portion of the rail.

10. The elevator of claim 9, further comprising:

a driving motor connected to a driving pulley;

a driven pulley provided apart from the driving pulley;

a driving belt wound around the driving pulley and the driven pulley, the door being attached to the driving belt.

11. The elevator of claim 9, wherein the thermal barrier covers the surface of the rail in contact with the door header.

12. The elevator of claim 9, wherein the thermal barrier covers at least a portion of the rail that is contacted by the roller when the door is in a closed position.

13. The elevator of claim 9, wherein the thermal barrier covers at least the portion of the rail that is contacted by the tire material of the roller.

14. The elevator of claim 9, wherein the supporting surface of the rail is comprised of a thermal barrier material.

15. The elevator of claim 9, wherein the thermal barrier is a coating applied to the rail.

16. The elevator of claim 9, wherein the thermal barrier is fabricated from a sheet of material secured to the rail.

17. The elevator of claim 9, wherein the roller comprises:

a rim portion adjacent a hub portion; and wherein the tire material surrounds the rim portion.

18. The elevator of claim 17, wherein a second thermal barrier covers the rim portion of the roller.

19. The elevator of claim 17, wherein a second thermal barrier covers the hub portion of the roller.

20. A roller assembly comprising:

a frame defining a doorway;

a rail including at least one supporting surface along at least one side of the rail, the rail secured to the frame;

at least one roller that is adapted to roll along the supporting surface of the rail, the roller having a tire material that contacts the rail; and a thermal barrier positioned to inhibit heat transfer from the rail to the tire material;

wherein the thermal barrier is selected from the group consisting of silica, mineral wool, ceramic fiber, fiberglass, alumina fiber, alumina-silica fiber, ceramic coatings, intumescent material, and multilayer thermal barrier coating, and wherein the thermal barrier covers at least a portion of the rail.

21. The assembly of claim 20, wherein the thermal barrier covers a surface of the rail in contact with the frame.

22. The assembly of claim 20, wherein the thermal barrier covers at least a portion of the rail that is the supporting surface for the roller.

23. The assembly of claim 20, wherein the roller comprises:

a rim portion adjacent a hub portion; and wherein the tire material surrounds the rim portion.

24. The assembly of claim 23, wherein a second thermal barrier covers the rim portion of the roller.

25. The assembly of claim 23, wherein a second thermal barrier covers the hub portion of the roller.

26. A method comprising:

a) providing a door assembly mounted on a frame defining a doorway for at least one door, wherein the one door is movably supported on the frame by attachment to at least one roller with a tire material supported on a rail secured to the frame;

b) applying a thermal barrier selected from the group consisting of silica, mineral wool, ceramic fiber, fiberglass, alumina fiber, alumina-silica fiber, ceramic coatings, intumescent material, and multilayer thermal barrier coating to at least a portion of the rail to inhibit heat transfer from the rail to the tire material.

27. The method of claim 26, wherein applying the thermal barrier comprises substantially covering the surface of the rail in contact with the frame.

28. The method of claim 26, wherein applying the thermal barrier comprises substantially covering the surface of the rail in contact with the tire material of the roller with the thermal barrier.

29. The method of claim 26, further comprising:

c) covering at least a portion of the roller with a second thermal barrier.

30. A door assembly comprising:

a door header mounted on a frame defining a doorway;

a door movably supported on the frame;

a rail including at least one supporting surface along at least one side of the rail, the rail secured to the door header;

at least one roller that is adapted to roll along the supporting surface of the rail, the roller having a tire material that contacts the rail; and an intumescent material positioned between the rail and the tire material.

* * * * *